United States Patent [19]

Chapman et al.

[11] Patent Number: 4,549,251

[45] **Date of Patent: * Oct. 22, 1985**

[54] DISCHARGE LAMPS

[75] Inventors: John M. Chapman, Petersfield; Basil Antonis, London, both of England

[73] Assignee: Thorn EMI plc, London, England

[ * ] Notice: The portion of the term of this patent subsequent to Jul. 3, 2001 has been disclaimed.

[21] Appl. No.: 561,997

[22] Filed: Dec. 16, 1983

Related U.S. Application Data

[63] Continuation of Ser. No. 342,343, Jan. 25, 1982, Pat. No. 4,458,301.

[30] Foreign Application Priority Data

Jan. 27, 1981 [GB] United Kingdom ..... 8102508
Mar. 31, 1981 [GB] United Kingdom ..... 8109947

[51] Int. Cl.[4] ..... F21S 5/00

[52] U.S. Cl. ..... 362/216; 362/217; 362/295; 313/264

[58] Field of Search ..... 362/216, 217, 295; 313/264, 356, 220, DIG. 5

[56] References Cited

U.S. PATENT DOCUMENTS

| | | | |
|---|---|---|---|
| 2,304,594 | 12/1942 | Pennybacker | 326/216 |
| 2,451,987 | 10/1948 | Sloan | 313/264 |
| 2,473,878 | 6/1949 | Greiner | 362/216 |
| 4,161,020 | 7/1979 | Miller | 362/216 |
| 4,173,730 | 11/1979 | Young et al. | 315/DIG. 5 |
| 4,268,780 | 5/1981 | Roche et al. | 315/DIG. 5 |
| 4,318,160 | 3/1982 | Dooley et al. | 362/216 |
| 4,458,301 | 7/1984 | Chapman et al. | 362/216 |

FOREIGN PATENT DOCUMENTS

| | | | |
|---|---|---|---|
| 839975 | 8/1950 | Fed. Rep. of Germany . | |
| 183478 | 10/1955 | Fed. Rep. of Germany | 362/216 |
| 2725329 | 12/1978 | Fed. Rep. of Germany . | |
| 2724528 | 12/1978 | Fed. Rep. of Germany . | |
| 834422 | 2/1938 | France | 362/216 |
| 2033653 | 10/1978 | United Kingdom . | |
| 2023924 | 1/1980 | United Kingdom . | |
| 1582885 | 1/1981 | United Kingdom . | |

OTHER PUBLICATIONS

Illuminating Engineering (vol. XXXVIII Jan.-Dec., 1943) Illuminating Engineering Society.

*Primary Examiner*—Peter A. Nelson
*Attorney, Agent, or Firm*—Fleit, Jacobson, Cohn & Price

[57] ABSTRACT

The invention provides an advantageous shape of discharge tube and a discharge lamp including such a tube which is particularly beneficial for use in dimensions intended to replace general lighting service lamps but can readily be adapted to other sizes. The discharge tube is shaped to define a substantial part of the boundary of a substantially planar zone. The part of the tube defining the boundary includes at least one straight portion. In one embodiment it defines three sides of a square with the ends of the tube being re-entrant into the fourth side. In a preferred embodiment a support housing central to the zone holds the ends of the tube thereby supporting it. Preferably one or more arms extending from the support housing grip the tube between its ends for further support. The support housing may include some circuit elements and provides electrical connection to the lamp as well as providing a convenient point to handle the lamp.

15 Claims, 11 Drawing Figures

DISCHARGE LAMPS

This is a continuation of application Ser. No. 342,343 filed Jan. 25, 1982, now U.S. Pat. No. 4,458,301.

This invention relates to discharge lamps and in particular to fluorescent lamps of the type having a relatively lengthy discharge tube which is bent into a convoluted shape so as to be more compact.

Fluorescent lamps bent into the form of a 'U' or into a nearly complete circle are well known and recently smaller tubes of these shapes have been produced as possible substitutes for general lighting service (GLS) lamps. A further development with this in mind has been the folding of a discharge tube first in the centre through 180° about one axis and at a quarter and three quarters of its length through 180° about an orthogonal axis. More recently the development of fluorescent lamp phosphors capable of withstanding much higher power loadings has made possible a reduction in tube diameter sufficient to allow the bending of tubes into a volume approaching that of the general lighting service filament lamp. An example of such a lamp is described in UK Patent Application No. 2 033 653A.

This lamp has one disadvantage in that to ensure safe handling it must be enclosed in a protective outer bulb. This leads to light loss and a temperature rise, exacerbated by heat produced in the ballast, which necessitates the use of complicated means to control the mercury vapour pressure within the fluorescent tube near to the desired level. It has a further disadvantage that it does not lend itself to use in relatively flat lighting fittings.

Another convoluted shape of discharge tube is disclosed in British Patent No. 1 582 885 which shows a tube spirally bent in opposite directions from the centre to the ends. The spiral extends so that the ends are brought together facing in the same direction and overlying the centre. This shape has the disadvantage that it does not lend itself to use in substantially flat fittings, and it is thought to be somewhat awkward to handle. Manufacture of a tube of this shape is also believed to involve the risk of inadequate adhesion of the phosphor coating and to lead to some loss in light output and deleterious effects in relation to the maintenance of light output during lamp life.

The circular shape of tube already referred to also suffers the disadvantages discussed in the preceding sentence, and is thought to be relatively inefficient in its use of space.

The 'U' shape already referred to is also thought to be relatively inefficient in its use of space except in relation to long and narrow fittings. It does not lend itself to use singly in square or circular relatively flat fittings.

It is an object of this invention to provide an alternative form for a discharge lamp with a folded or convoluted discharge tube to provide a highly compact lamp not requiring the protection of an outer bulb or outer framework.

According to the invention there is provided a discharge tube disposed substantially in a plane and shaped to define a substantial part of the boundary of a zone in the plane, the ends of the tube being re-entrant into the zone and the part of the tube defining the boundary including at least one straight portion.

According to a further aspect of the invention there is provided a fluorescent lamp including: a discharge tube, having an electrode at each end thereof, disposed substantially in a plane and shaped to define a substantial part of the boundary of a zone in the plane, the part of the tube defining the boundary including at least one straight portion and the ends of the tube being re-entrant into the zone; and a lamp support housing lying within the zone, receiving the ends of the tube and providing electrical connection to the electrodes.

According to yet another aspect of the invention there is provided a fluorescent lamp having a discharge tube folded into a plurality of sections at least some of which are straight to form the boundary of a substantially planar zone with the ends being re-entrant into the zone and within the zone a support housing adapted to receive and support the ends of the tube, the housing further including means for rigidly supporting the tube between said ends.

In order that the invention may be clearly understood and readily carried into effect it will now be described by way of example with reference to the accompanying drawings, of which:

Figure 1:
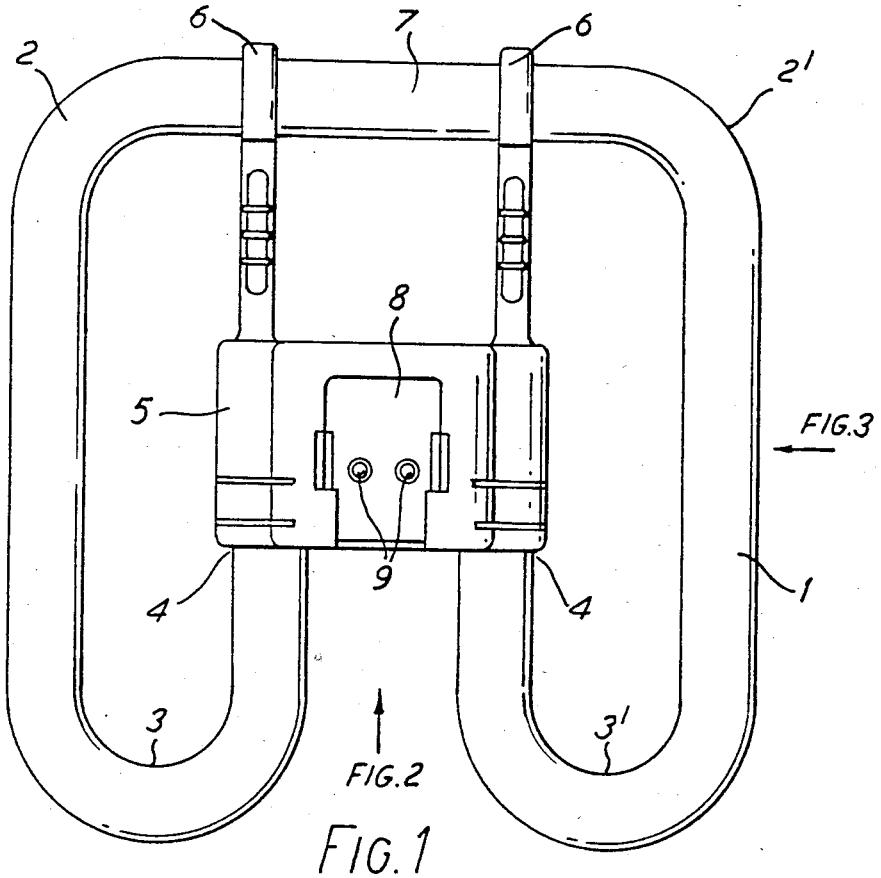
FIG. 1 shows the lamp of one example of the invention in underplan.
Figure 2:
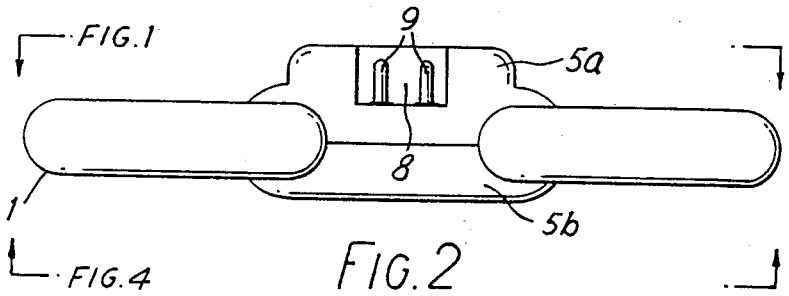
FIG. 2 shows the lamp of FIG. 1 in end elevation.
Figure 3:
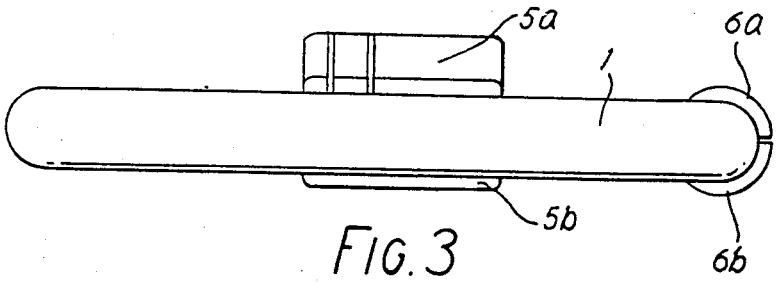
FIG. 3 shows the lamp of FIG. 1 in side elevation.
Figure 4:
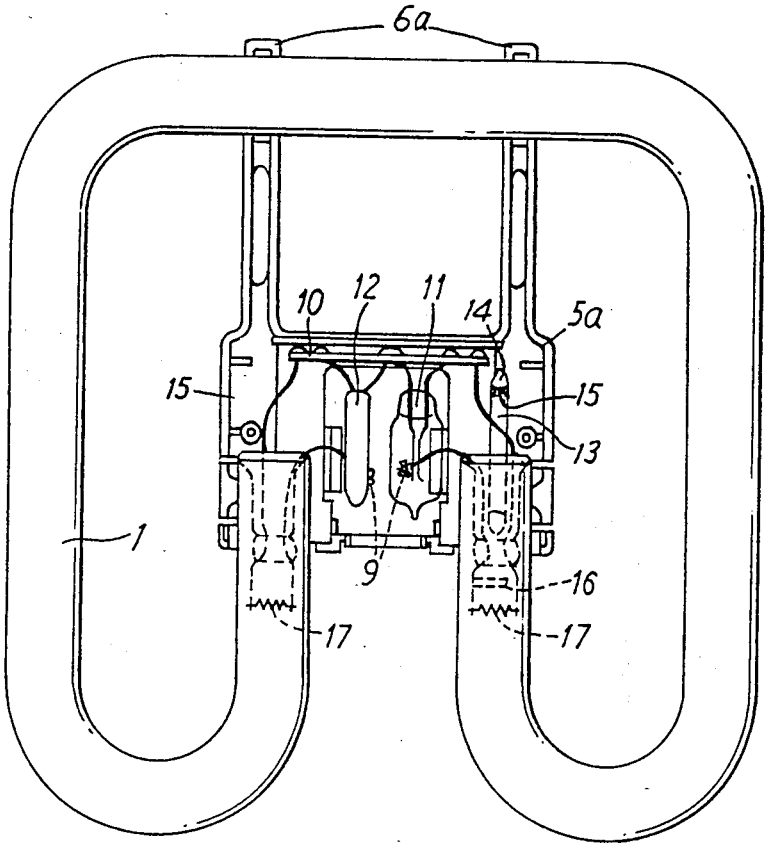
Figure 4A:
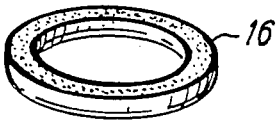
Figure 5A:
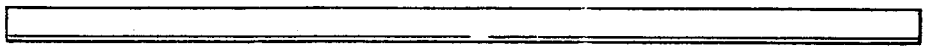
Figure 5B:
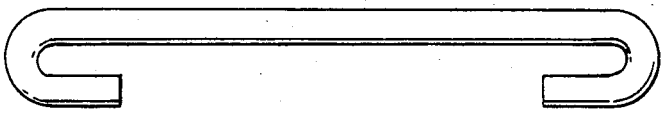
Figure 5C:
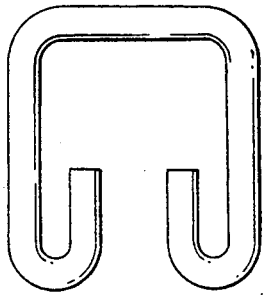
Figure 6A:
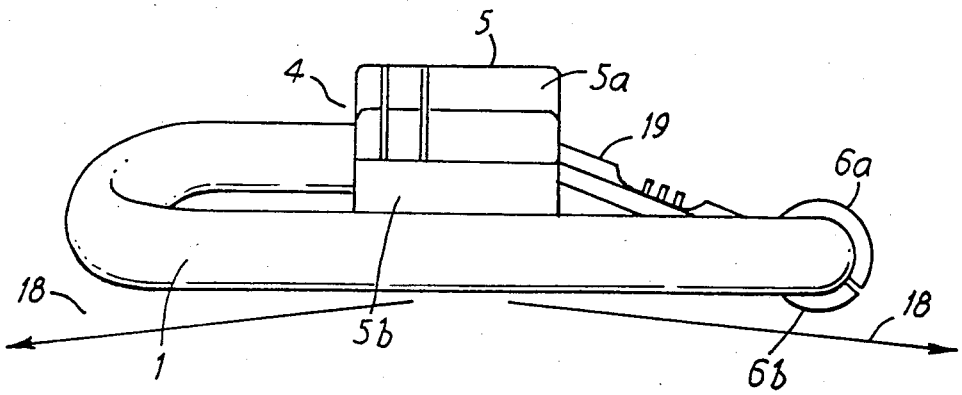
Figure 6B:
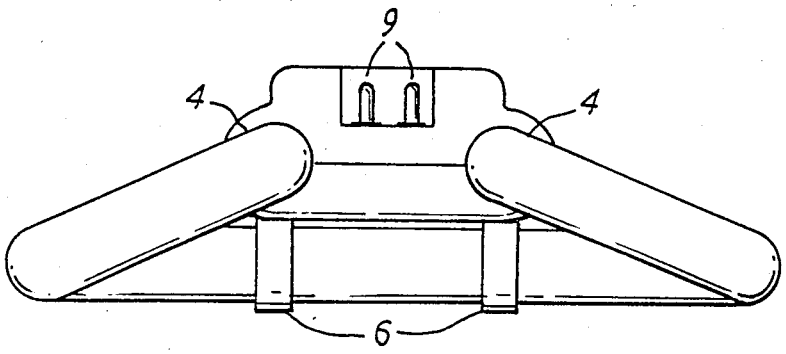
Figure 7:
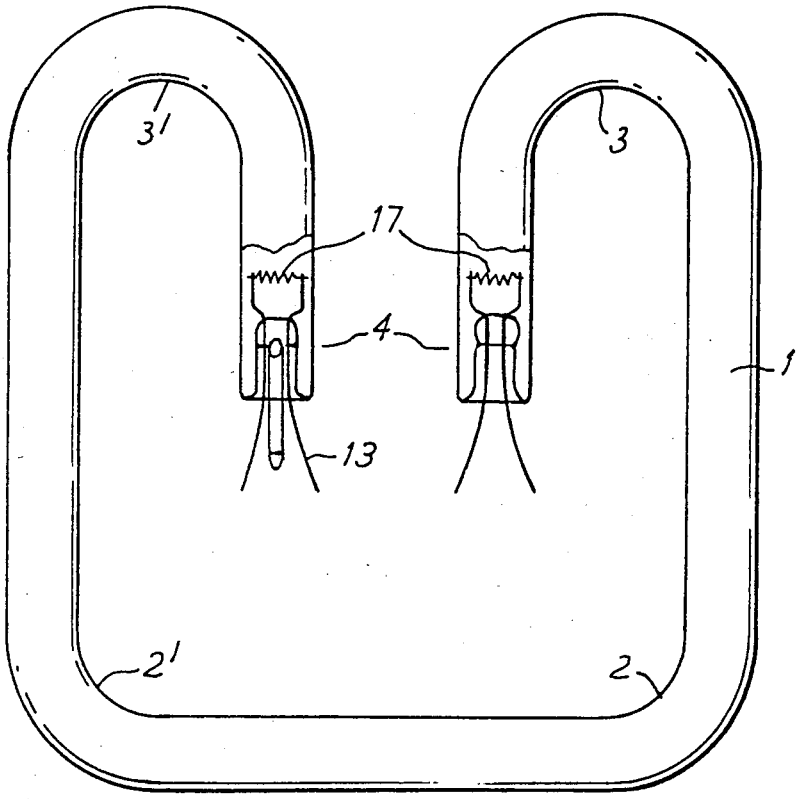

FIG. 4 shows the lamp of FIG. 1 in plan with the support housing cover removed to reveal components mounted within, FIG. 4*a* shows the getter/mercury dispenser ring of FIG. 4 in more detail, FIGS. 5*a*, 5*b* and 5*c* illustrate stages of formation of the tube into the shape of the FIG. 1 example of this invention, FIGS. 6*a* and 6*b* show in side and end elevation respectively another example of a lamp in accordance with the invention in which the central support housing is disposed out of the principal plane of the lamp, and FIG. 7 shows a discharge tube of the shape of the example of FIGS. 1 to 4.

The discharge tube of the lamp of the invention defines a boundary to a zone in a plane, the boundary being of many different shapes. It has straight portions in which the tube has not been softened and which the phosphor, with which the tube is internally coated, is at less risk of disturbance. The boundary is conveniently polygonal. However, the shape of the preferred example of this boundary is substantially rectangular. The ends of the tube which preferably also are straight portions are re-entrant into the zone.

A lamp in accordance with this example of the invention is shown in underplan and end elevation respectively in FIGS. 1 and 2. Considering these two Figures together, the discharge tube 1, which is otherwise of conventional type for a fluorescent tube, is bent through 90° at 2, 2' to form three sides of a rectangle, in this example a square. The tube is further bent at 3 and 3' but at these points through 180° so that the ends 4 of the discharge tube are re-entrant into the square formed thereby. This tube is considered to define the boundary of a square zone, the break in the boundary necessitated by the re-entrant ends being disregarded. All bends are about parallel axes so that the resultant tube shape is flat, that is the tube lies in a plane of thickness substantially equal to the tube diameter.

Inside the square formed by the folded tube there lies in this example a lamp support housing 5 into which the ends 4 of the discharge tube 1 are fitted. The housing 5 encloses starter components and electrical connections and is formed in two parts 5*a* and 5*b* which press together for ease of assembly. Part 5*a* is, in this example, that on which the starter and connections are mounted and part 5*b* is formed as a simple cover. The housing is formed with arms 6, in this example two, which each terminate in a circular support gripping the tube 1 in its centre section 7. These are also in two parts each associated with one of the parts of the housing 5 to enclose the tube when they are pressed together.

Visible also in FIGS. 1 and 2 is a recess 8, in the upper part 5*a* of housing 5, to accommodate a lamp holder and therein are two terminal pins 9. The recess 8 and terminals 9 may take any suitable form as required.

The arrangement illustrated in which housing 5 includes two arms 6 gripping the centre part 7 of tube 1 is considered to give effective support to tube 1 to prevent relative movement of discharge tube and housing during handling. It is particularly advantageous in handling since it provides a convenient, and therefore natural, point at which to grip the lamp, reducing the risk of handling of the tube itself. It is also advantageous in not requiring excessive precision in placement of the ends of the tube at assembly. Bearing this in mind less or no support may be provided for applications in which tube support and tube are held together by other means, for example an adhesive material. Alternative positions of the arms may also be used. For example one supporting arm could be provided to each of the three straight tube sections although such a configuration reduces ease of assembly.

FIG. 3 is a side elevation of the lamp in which the principal feature visible is the manner in which the two parts of housing 5, at arms 6, grip the tube 1.

FIG. 4 shows a plan view of the lamp, that is from the opposite side to FIG. 1, with the cover part 5*b* removed to reveal the components mounted within the housing 5.

Visible in this Figure are circuit wiring, in this example a printed circuit board 10, on which are mounted, where required, elements such as a glow switch 11 and a radio interference suppression capacitor 12, both of well known type. The printed circuit board may be replaced by other means of making electrical connections and a lamp such as that of this invention can work satisfactorily without capacitor 12 or with the starter switch and capacitor situated externally of the lamp. It will be appreciated that the contents of housing 5 may be varied at will within the scope of this invention and may, advantageously, comprise an electronic ballast. Similarly the two terminal pins may be supplemented by other pins if the circuits used with the lamp should require them.

The lamp exhaust tube, shown at 13 between electrical connections to a tube electrode, is substantially longer than is usual for such a discharge tube. This long exhaust provides a cool region for the condensation of the reservoir of liquid mercury which must be available for partial vaporisation and use during the life of the lamp and the temperature of which determines the mercury vapour pressure. The length of the exhaust is chosen to ensure near optimum performance of the lamp. Use of the present invention allows the convenient use of a long exhaust with its attendant advantages, the exhaust in this embodiment being accommodated within housing 5. The exhaust tube in the example illustrated is tipped-off with a solid glass tip-off 14 and droplets of condensed mercury lie at 15, after the lamp has been run for a sufficient period. Such a long exhaust may be provided at each end of the discharge tube although such an arrangement is not favoured Vapour pressure control could be provided by use of the known mercury amalgam system, but this is more complicated.

It is preferred in this embodiment to use the well known getter/mercury dispenser ring as shown at 16 for the introduction of a small controlled mercury dose. This ring, which is shown in more detail in the pespective view of FIG. 4*a* comprises a nickel plated iron container having in it a mixture of "ST101" (Zr/Al getter) are mercury/titanium alloy. The small mercury dose, introduced as a vapour, has special advantages in relation to a compact domestic lamp. For example it reduces the risk of damage to the phosphor at the bends by a rolling mercury drop and provides faster stabilisation of the lamp.

It also reduces the quantity of mercury which may be released into the environment, which is particularly advantageous in domestic situations.

In the example of this lamp shown in FIGS. 1 to 4 the preferred gas fill is argon in the range 2 to 7 torr, 5 torr being considered most suitable. The mercury dose is in the range 1–7 mg.

Various provisions are recommended to assist in cooling. It is preferrred for the tube cathodes to be outside the housing 5 as shown at 17. The shape of the housing 5 with the arms 6 as shown is believed to aid ventilation and cooling in conjunction with cut-outs such as those visible in FIG. 1. The primary purpose of the cut-outs on housing 5 is, however, to provide resilience to grip and support the ends 4 of tube 1, and that of those of arms 6 to form part of a mechanism locking the two halves of the housing together.

The preferred method of construction of tube 1 into the shape of the invention is by taking a straight tube (FIG. 5*a*) internally coated with a suitable phosphor in conventional manner, heating it near the ends and bending it in those regions through 180° (FIG. 5*b*) and repeating the process to bend it again at the ⅓rd points through 90° (FIG. 5*c*). As shown the bends in the tube are relatively sharp but are still of course curved as limited by practical considerations. During bending it is desirable to pressurise the tube with a suitably inert gas to prevent the softened tube collapsing at the bends.

The tube may be of soda-lime glass as is usual for fluorescent lamp tubes or it may be of any other material suitable for making discharge tubes. For the example shown in FIGS. 1 to 4 the tube is preferred to be of diameter 12.75 to 13.25 mm (OD) and 0.8 to 0.9 mm wall thickness. The preferred centre line length after bending is 500–520 mm providing about 450–470 mm between the cathodes and with this length the lamp defines a square of about 135 mm and not exceeding 141 mm side.

Although FIGS. 1 to 4 illustrate one suitable embodiment the invention embraces many other shapes of tube which may be disposed around a support housing. It is not necessary for sides of the zone defined by the tube to be parallel or for all sides to include straight portions. Furthermore it is considered that the invention embraces many shapes of the said tube in which those parts of the tube defining the boundary of the zone, as distinct from the re-entrant ends, include at least one straight portion which has not been directly subject to the stresses of bending.

The embodiment illustrated by FIGS. 1 to 4 is, however, particularly preferred.

It will be understood for all examples of the invention that deviations of the convoluted tube from the plane in which it generally lies are envisaged provided they are not excessive. It is not envisaged that such deviations would be substantially greater than one tube diameter or the advantages of a generally flat lamp may be lost. The support housing may, however, be out of the plane of the tube, at least in part and the ends 4 of the tube may then deviate from the general plane sufficiently to enter the support housing. Such a design is illustrated in side elevation in FIG. 6*a* and in end elevation in FIG. 6*b*. Although not favoured, it does have the advantage of reducing interception by the support housing 5 of light on paths, such as illustrated at 18, passing to the side of and below the lamp. The arms 6 may be repositioned as at 19 to accommodate the displaced support housing.

Other minor deviations may be tolerated, for example for aesthetic reasons or for reasons of convenience of manufacture.

Although the present invention is particularly advantageous in the field of lamps of dimensions approaching those of general lighting service filament lamps it may be applied with advantage to lamps of very different dimensions larger and smaller including, but not limited to, the well known 26 mm and 38 mm diameter tubes. For such tubes it will be realised not only that the dimensions will be different to those given hereinbefore for the embodiment of FIGS. 1–4 but also that other figures given, such as those for gas fill pressure and mercury dose, will generally be different.

The lamp may be used for instance to replace circular lamps or combinations of 'U' shaped lamps with both efficiency and cost advantages. For these purposes the lamp may be used as a tube of the shape of the embodiment of FIGS. 1 to 4 but with end caps suitable for any conventional fitting or some alternative end housing and not necessarily with the central support housing of the preferred embodiment. An example of a tube of the invention in this form is shown in FIG. 7 although as shown not having end caps. The present invention is therefore considered to embrace fluorescent tubes of that shape with or without housing, mount, ballast or supporting circuits.

Whether or not fitted with the central support housing, a tube of that shape is considered to be advantageous at least because it is a convenient and practical shape for bending and lends itself to advantageous forms of centre support. It is preferred that at least one third of the length of the tube should be straight but the invention is not intended to be so limited.

An important aspect of the invention is its flatness which enables it to be used in substantially flat and unobtrusive fittings. In relation to domestic ligting fittings it is thought that its flatness and compactness give new scope to the fittings designer.

It is believed that the tube of present invention is a particularly versatile form of convoluted discharge tube.

What we claim is:

1. A fluorescent lamp, adapted to co-operate with a lamp holder in the manner of a general lighting service filament lamp, comprising:

a discharge tube internally coated with phosphor and having tube ends and an electrode disposed at each tube end, a lamp support housing fixed to said tube, external electrical connection means carried by said lamp support housing, and internal electrical connection means connecting the external electrical connection means to the tube, wherein:

the discharge tube is disposed substantially in a plane and shaped at least in part to define a substantial part of the boundary of a zone in the plane, the part of the tube defining the boundary including at least one straight portion, the lamp support housing lying in a central part of said zone spaced from the tube and the ends of the tube being re-entrant into said central part of said zone such that the ends of the tube are received within the lamp support housing and wherein the external electrical connection means comprises a terminal lying within said central part of said zone to co-operate with said lampholder and facing in a direction normal to said plane whereby said lamp requires to be urged in said direction normal to said plane to make electrical connection with said lamp holder.

2. A fluorescent lamp, adapted to co-operate with a lamp holder in the manner of a general lighting service filament lamp, comprising:

a discharge tube internally coated with phosphor and having tube ends and an electrode disposed at each tube end, the discharge tube being disposed substantially in a plane shaped at least in part to define a substantial part of the boundary of a zone in the plane, the part of the tube defining the boundary including at least one straight portion;

a lamp support housing fixed to said tube lying within said zone, spaced from said tube and receiving the ends of said tube and at least one lamp support arm appended to said lamp support housing and extending from the lamp support to one of said straight portions thereby preventing relative movement between said lamp support housing and said tube;

external electrical connection means carried by said lamp support housing comprising a recess and a terminal in the recess extending in a direction normal to said plane; and internal electrical connection means connecting the external connection means to the tube.

3. A fluorescent lamp according to claim 2, wherein the lamp support housing comprises two complementary shell portions pressed against each other in a plane of abutment with one of said shell portions carrying the external electrical connection means in the form of terminal pins.

4. A fluorescent lamp, adapted to co-operate with a lamp holder in the manner of a general lighting service filament lamp, comprising:

a discharge tube internally coated with phosphor and having tube ends and an electrode disposed at each tube end;

a lamp support housing fixed to said tube;

external electrical connection means carried by said lamp support housing;

internal electrical connection means connecting the external connection means to the tube, wherein;

the discharge tube is disposed substantially in a plane and shaped to define a substantial part of the boundary of a zone in the plane, said tube ends being bent to be re-entrant into said zone and being received within a part of said lamp support housing, said lamp support housing comprising two complementary shell portions spaced from said tube and pressed against each other in a plane of abutment, said ends of said tube being symmetrically disposed about said plane of abutment and one of said complementary shell portions carrying external electrical connection means in the form of terminal pins.

5. A fluorescent lamp according to claim 4, wherein the discharge tube defines a substantially square zone and wherein said lamp support housing lies substantially centrally within said zone.

6. A fluorescent lamp according to claim 4, wherein said lamp support housing includes at least a lamp support arm extending between the lamp support housing and said tube thereby to support said tube.

7. A fluorescent lamp, adapted to co-operate with a lamp holder in the manner of a general lighting service filament lamp, comprising:

a discharge tube internally coated with phosphor having tube ends and an electrode disposed at each tube end;

a lamp support housing fixed to but otherwise spaced from said tube;

external electrical connection means carried by said lamp support housing;

internal electrical connection means connecting the external electrical connection means to the tube, wherein:

the discharge tube is disposed substantially in a plane and has straight portions shaped to form three sides of a square with the ends of the tube being bent re-entrant into the square at the fourth side, said lamp support housing lying substantially centrally within said square and said tube ends being received within the lamp support housing said lamp support housing having at least one lamp support arm extending from the lamp support housing to one of said straight portions thereby preventing relative movement betwen said lamp support housing and said tube, said lamp support housing comprising two half housings abutting each other centrally of said tube ends and wherein one of said half housings includes terminal pins forming the external electrical connection means, the terminal pins extending in a direction normal to said plane whereby said lamp has to be urged in said direction to make electrical connection with a lamp holder.

8. A fluorescent lamp including:

(a) a discharge tube, internally coated with phosphor, disposed substantially in a plane and shaped to provide three straight portions of tube bent to form three sides of a rectangle to define a substantial part of the boundary of a rectangular zone in the plane, the ends of the tube being re-entrant into the zone;

(b) a lamp support housing lying substantially centrally within the zone spaced from said tube with the ends of the tube entering into the housing;

(c) holding means within the housing resiliently gripping the ends of the tube; and (d) at least one support arm, appended to the lamp support housing, gripping the tube between said ends to fix the support housing relative to the tube.

9. A fluorescent lamp according to claim 8 in which the lamp support housing comprises two half housing parts which are pressed into abutment to lock together as a single housing.

10. A fluorescent lamp according to claim 9 in which each said half housing parts includes a part of said at least one lamp support arm having means adapted to lock the two halves together.

11. A fluorescent lamp according to claim 8 in which at least one end of the tube has a long exhaust for control of mercury vapour pressure.

12. A fluorescent lamp according to claim 8 in which the lamp support housing includes an external recess and electrical connections provided within the recess.

13. A fluorescent lamp according to claim 12 in which the electrical connections comprise contact pins disposed to make connection to a socket in a direction perpendicular to said plane.

14. A fluorescent lamp, adapted to co-operate with a lamp holder in the manner of a general lighting service filament lamp, comprising:

a discharge tube internally coated with phosphor and having tube ends and an electrode disposed at each tube end, one of said tube ends including a long exhaust tip, a lamp support housing fixed to said tube and having situated therein said exhaust tip, external electrical connection means carried by said lamp support housing;

internal electrical connection means connecting the external connection means to the tube, wherein:

the discharge tube is disposed substantially in a plane and shaped to define a substantially square zone in the plane and wherein said lamp support housing lies substantially centrally within said zone said tube ends being bent to be re-entrant into said zone and being received within a part of said lamp support housing spaced from the remaining part of said tube, said electrodes being disposed adjacent respective tube ends but outside said lamp support housing.

15. A fluorescent lamp, adapted to co-operate with a lamp holder in the manner of a general lighting service filament lamp, comprising:

a discharge tube internally coated with phosphor and having tube ends and an electrode disposed at each tube end, one of said tube ends including a long exhaust tip, a lamp support housing fixed to said tube and having situated therein said exhaust tip, said lamp support housing including at least a lamp support arm extending between the lamp support housing and the tube thereby to support the tube, external electrical connection means carried by said lamp support housing;

internal electrical connection means connecting the external connection means to the tube, wherein:

the discharge tube is disposed substantially in a plane and shaped to define a substantial part of the boundary of a zone in the plane, said tube ends being bent to be re-entrant into said zone and being received within a part of said lamp support housing spaced from the remaining part of said tube, said electrodes being disposed adjacent respective tube ends but outside said lamp support housing.

* * * * *